United States Patent [19]

Light et al.

[11] Patent Number: 4,832,128

[45] Date of Patent: May 23, 1989

[54] WELLHEAD ASSEMBLY FOR INJECTION WELLS

[75] Inventors: Bruce D. Light, Kenner; Dennis P. Louviere, Convent, both of La.

[73] Assignee: Shell Pipe Line Corporation, Houston, Tex.

[21] Appl. No.: 920,110

[22] Filed: Oct. 17, 1986

[51] Int. Cl.[4] ..... E21B 23/00; E21B 33/072

[52] U.S. Cl. ..... 166/377; 166/70; 166/77; 166/85; 166/90; 166/379; 166/385

[58] Field of Search ..... 166/377, 379, 385, 70, 166/77, 80, 85, 90, 95, 97, 305, 75.1, 312, 76, 97.5; 405/59, 53, 128

[56] References Cited

U.S. PATENT DOCUMENTS

| | | | |
|---|---|---|---|
| 1,400,962 | 12/1921 | Leonard | 166/95 |
| 3,036,635 | 5/1962 | Corley Jr. et al. | 166/385 |
| 3,248,132 | 4/1966 | Pierce Jr. | 166/89 |
| 4,241,786 | 12/1980 | Bullen | 166/77 |
| 4,317,486 | 3/1982 | Harris | 166/70 |
| 4,365,978 | 12/1982 | Scott | 405/59 |
| 4,553,591 | 11/1985 | Mitchell | 166/76 |
| 4,625,797 | 12/1986 | Taitsumi et al. | 166/90 |
| 4,681,168 | 7/1987 | Kisling | 166/381 |

OTHER PUBLICATIONS

J. H. McCoy and J. B. Ashley, "Continuous Sonar Interface Detection for Underground Storage Caverns", Fourth Annual International Symposium on Salt, Houston, Texas Apr. 1973.

Brochure, Interface Detector for Storage Cavern Wells/Continuous Indication of Interface Depth, Interface Detector Company, Wichita Falls, TX.

*Primary Examiner*—Hoang C. Dang

*Attorney, Agent, or Firm*—Mark A. Smith

[57] ABSTRACT

A wellhead assembly is disclosed which accepts a downhole tool run on a wireline within an injection bore in which a central wellhead member has an injection port in communication with the injection bore upstream of an isolation valve within the injection bore. A stinger in the injection bore is movable between an extended position and a retracted position. The extended position of the stinger protects the wireline and the retracted position permits the downhole tool to be withdrawn upstream of the isolation valve.

17 Claims, 3 Drawing Sheets

WELLHEAD ASSEMBLY FOR INJECTION WELLS

BACKGROUND OF THE INVENTION

This invention relates to a wellhead assembly and method of operation and, more particularly, to a wellhead assembly which accepts a downhole tool run on a wireline within an injection bore in which the wireline is protected from the flow of the injected fluid at the injection port, but which does not interfere with an isolation valve in the injection bore and provides for convenient removal or change of downhole tools.

Many downhole tools have been developed in recent years for performing tasks within pipe strings of formations from the end of a wireline. However, problems develop when the application requires that such downhole tools monitor conditions or otherwise perform tasks while fluid is injected into the bore containing the wireline and downhole tool. The fluid flows transverse to the wireline at the injection port where it enters the injection bore and subjects the wireline to potentially serious vibration and erosion.

The prior art has addressed these problems by threading the wireline through a strong, rigid cable protector or stinger which covers the wireline in the immediate vicinity of the injection port. However, the stinger of the prior art is deployed through an isolation valve and renders the isolation valve inoperative, whereby seriously compromising the safety of operations at the well. Further, the inoperative isolation valve forces operations requiring insertion, removal or replacement of the downhole tool to be performed at atmospheric pressure. However, there are other safety concerns in steps necessary to reduce the pressure. In addition, such depressurization steps are inconvenient, often counterproductive to the purposes of the injection well and sometimes seriously damaging to downhole operations.

SUMMARY OF THE INVENTION

It is therefore an object of the present invention to provide a wellhead assembly which admits downhole tools on a wireline into an injection bore but which will not interfere with immediate closure of an isolation valve in emergency situations.

Another object of the present invention is to provide a wellhead assembly which accepts downhole tools on a wireline into an injection bore and provides for protection of the wireline from the injected flow, yet provides for convenient closure of the isolation valve without sacrificing the tool and wireline.

Further, it is an object of the present invention to provide a wellhead assembly and method of operation which admit downhole tools on a wireline into an injection bore and provides for the protection of the wireline, yet allows convenient insertion, removal and/or replacement of the downhole tool without depressurizing the injection bore.

The present invention is a wellhead assembly which accepts a downhole tool run on a wireline within an injection bore in which a central wellhead member has an injection port in communication with the injection bore upstream of an isolation valve. A stinger in the injection bore is movable between an extended position and a retracted position. The extended position of the stinger protects the wireline and the retracted position permits the downhole tool to be withdrawn upstream of the isolation valve. Means are provided for moving the stinger between the extended and retracted positions.

BRIEF DESCRIPTION OF THE DRAWINGS

The above brief description as well as further objects, features and advantages of the present invention will be more fully appreciated by reference to the following detailed description of the presently preferred, but nonetheless illustrative, embodiment of the present invention with reference to the accompanying drawings in which.

DESCRIPTION OF THE PREFERRED EMBODIMENT

Figure 1:
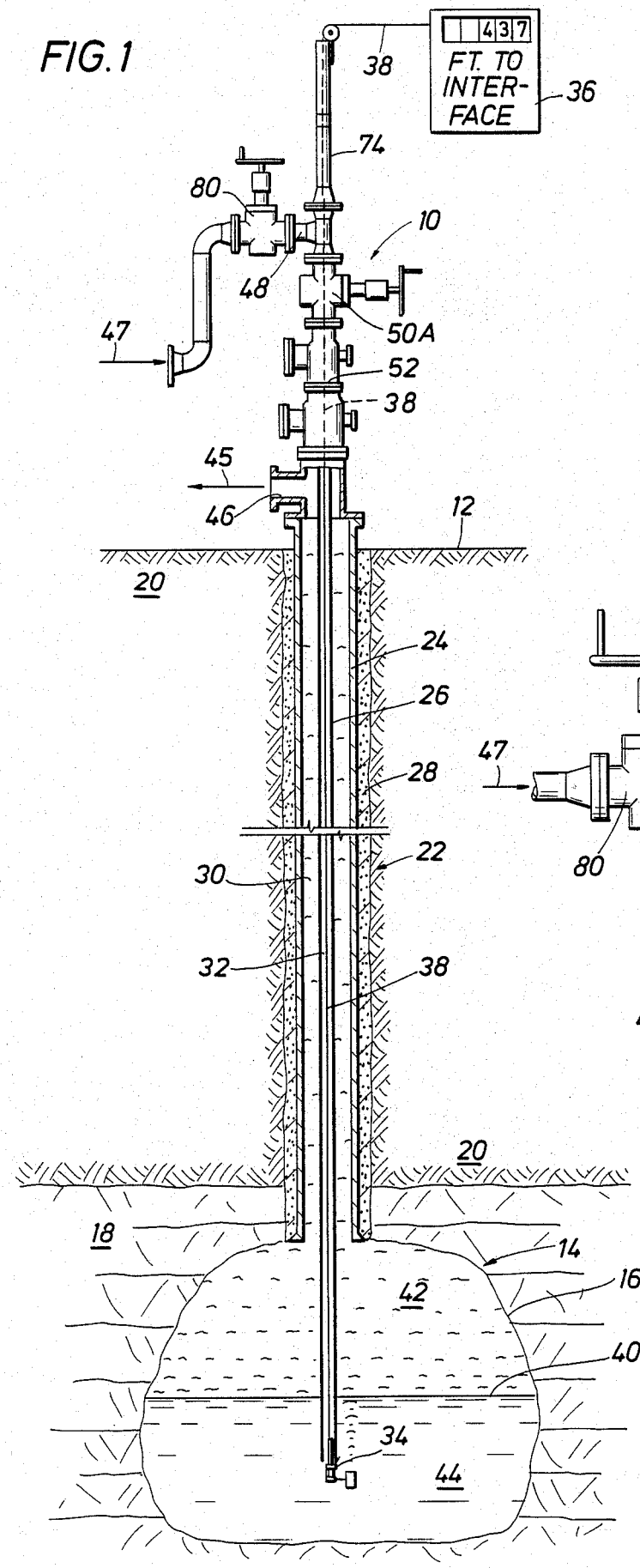
FIG. 1 is a partially cross-sectional view of a wellhead assembly constructed in accordance with the present invention in operation.

Downhole tools run on wirelines materially aid many injection well applications and use of the present invention will be taught to those of ordinary skill in the art for a full range of such applications by this disclosure. FIG. 1 is merely illustrative of one application, depicting underground storage of LPG or other petrochemical products accessed through an injection well.

In the embodiment of FIG. 1, wellhead assembly 10 on surface 12 is connected to storage facility 14 through multiple pipe string 22. Storage facility 14 is provided by cavern 16 within bedded or domal salt formation 18 beneath strata 20. Multiple pipe string 22 may have more than one product string 24 which are concentric to an injection string 26. The outermost product string or casing 24 is bonded to strata 20 and salt formation 18 with cement 28. A product annulus 30 is formed between product string 24 and injection string 26 and continues into wellhead assembly 10 and ballast or injection bore 32 in formed within ballast or injection string 26 and similarly extends into the wellhead assembly. A wireline downhole tool 34 is run from surface facilities 36 which include winching equipment and instrumentation, through wellhead assembly 10 and down injection bore 32 on a wireline 38.

FIG. 1 is simplified for the purposes of illustrating an environment of the present invention. Most often a plurality of cemented casings will be present and the product string and the injection string extend downhole suspended on a hanger from the casing.

In the illustrated application, downhole tool 34 is an interface detector which hingedly swings about the end of injection string 26 to measure the inventory of a product 42 within storage facility 14 by measuring the distance between the terminal end of injection bore 32 and interface 40 between the stored product 42 and an injection or ballast fluid 44.

Product 42 such as LPB, olefins, or other petrochemical products, enters and leaves storage facility 14 through one or more product ports 46 through stack or central wellhead member 52 to communicate with storage facility 14 through product annulus 30. The product port may be provided with a product valve (not shown). Similarly, ballast fluid 44 enters or leaves storage facility 14 through an injection port 48 through central storage member 52 to communicate with storage facility 14 through injection bore 32. See arrow 47 representing the addition of ballast fluid. Ballast fluid 44 such as fresh water or brine has a greater density than does product fluid 42 and the injected ballast fluid collects beneath product fluid 42 in the underground storage facility. Ballast fluid 44 serves to drive substantially incompressible products such as crude oil from storage facility 14 by displacing the product and forcing it up the product annulus for withdrawal. See arrow 45. In this case the product inventory is a simple function of the level of interface 40 for a known size and geometry of storage facility 14. In applications for storage of compressible products such as LPG, ballast fluid 44 reduces the volume of storage facility 14 available for the product as a means to pressurize the product. In the latter example, pressure drives the compressible product from the storage facility for withdrawal and the product inventory is a function of both the level of the interface and the pressure exerted by the product for a given storage facility.

Conversely, ballast fluid 44 is withdrawn through injection bore 32 when a substantially incompressible product 42 is advanced through product annulus 30 for storage within cavern 16. Similarly, ballast fluid may be withdrawn at a rate to maintain optimum pressure on an advancing compressible fluid. In either case, fluid pressure is maintained on all surfaces of cavern 16, thereby protecting the integrity of underground storage facility 14 during product storage and product withdrawal by partially compensating for the external geoforces acting inwardly on cavern 16.

An isolation valve 50 is positioned within stack or central wellhead member 52 downstream of injection port 48.

Figure 2:
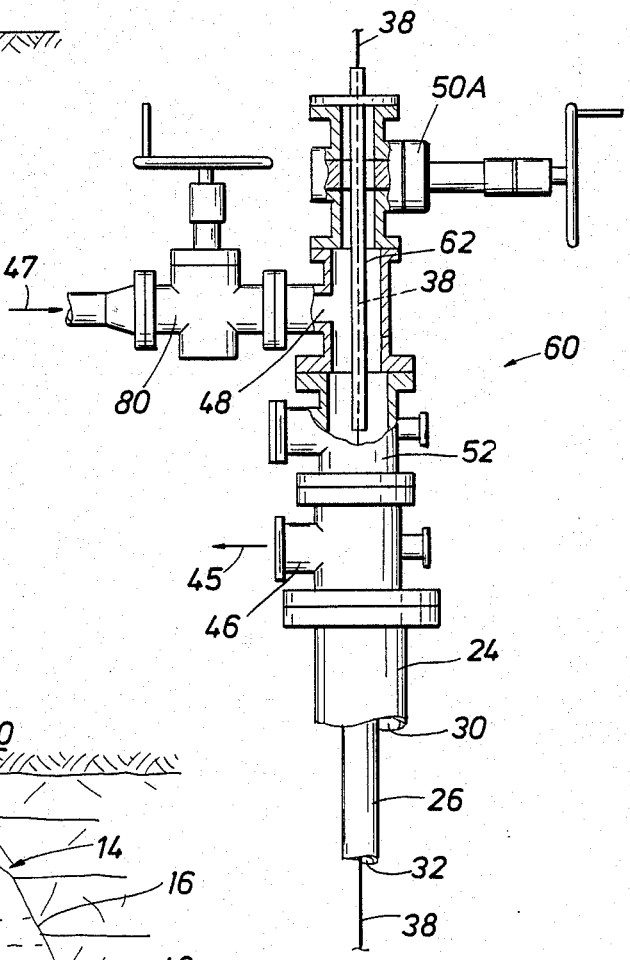
FIG. 2 (PRIOR ART)
FIG. 2 is a partially cross-sectional view of a wellhead assembly having a stinger constructed in accordance with the prior art.

FIG. 2 illustrates a wellhead assembly 60 of the prior art. Wellhead assembly 60 does provide for the use of a downhole tool (not shown) suspended upon wireline 38 within injection bore 32. Again, product ports 46 communicate with product annuluses 30 and injection port 48 communicates through central wellhead member 52 to communicate with injection bore 32.

FIG. 2 is partially cross-sectioned to illustrate a stinger 62 which, in the prior art, is a rigid, fixed, hollow tubular member which extends from the top of central wellhead member 52 through isolation valve 50 and past injection port 48. Prior art stinger 62 serves to protect wireline 38 which is strung therethrough at the juncture of injection port 48 where transverse flow of ballast fluid might otherwise cause severe vibration to the wireline and thereby to the downhole tool and might eventually erode wireline 38 to an extent that the wireline would fail and both the wireline and downhole tool would be lost to the bottom of the underground storage facility (not shown).

Figure 3:
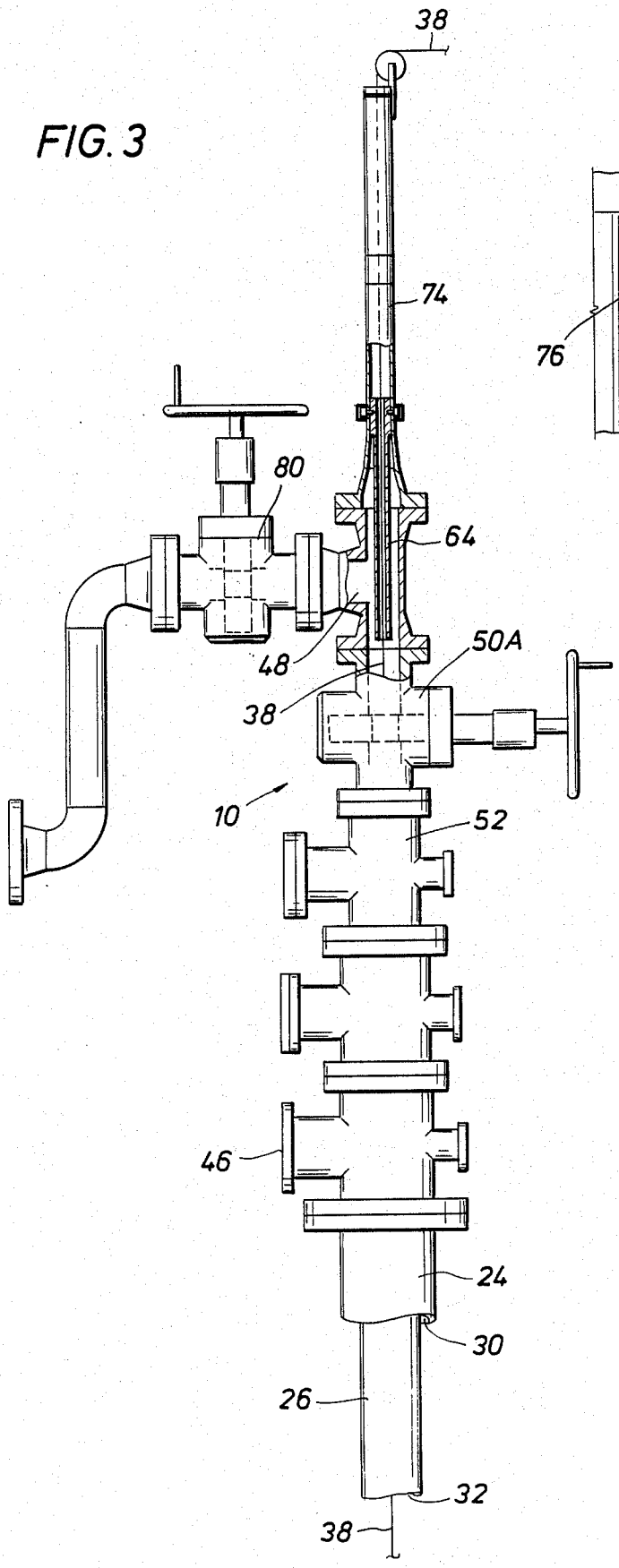
FIG. 3 is a partially cross-sectional view of a wellhead assembly constructed in accordance with the present invention in which a stinger is extended to a position adjacent the injection port.

By contrast, FIG. 3 is a partially cross-sectioned view of wellhead assembly 10 constructed in accordance with the present invention. Like the prior art, there is a central wellhead member 52 which connects injection port 48 to the portion of injection bore 32 within injection string 26 and connects product port 46 to product annulus 30 within the product string. Again, an isolation valve 50 is within the central wellhead member across injection bore 32. However, in the present invention, isolation valve 50 is downstream of injection port 48 in central wellhead member 52.

Figure 6:
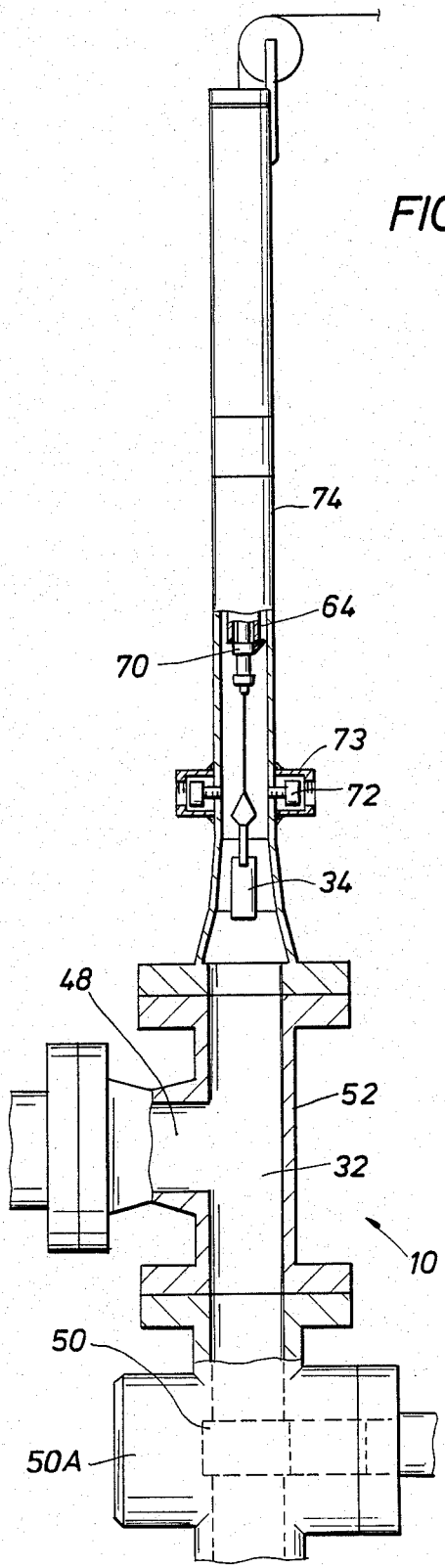
FIG. 6 is a partially cross-sectional view of the wellhead assembly in FIG. 3 in which the stinger is retracted and the isolation valve is closed.

Stinger 64, like stinger 62 of the prior art as illustrated in FIG. 2, protects wireline 38 as it passes injectoin port 48. However, stinger 64 need not block isolation valve 50 and, in the preferred embodiment, is movable between an extended position which is illustrated in FIG. 3, adjacent injection port 48 and extending thereacross to protect wireline 38 and a retracted position which is illustrated in FIG. 6, providing clearance of the stinger and downhole tool 34 (not shown) above isolation valve 50.

FIGS. 3–6 illustrate a method for deploying downhole tool 34 on wireline 38 within injection bore 32 and a method of removing the downhole tool through the wellhead assembly 10.

Figure 4:
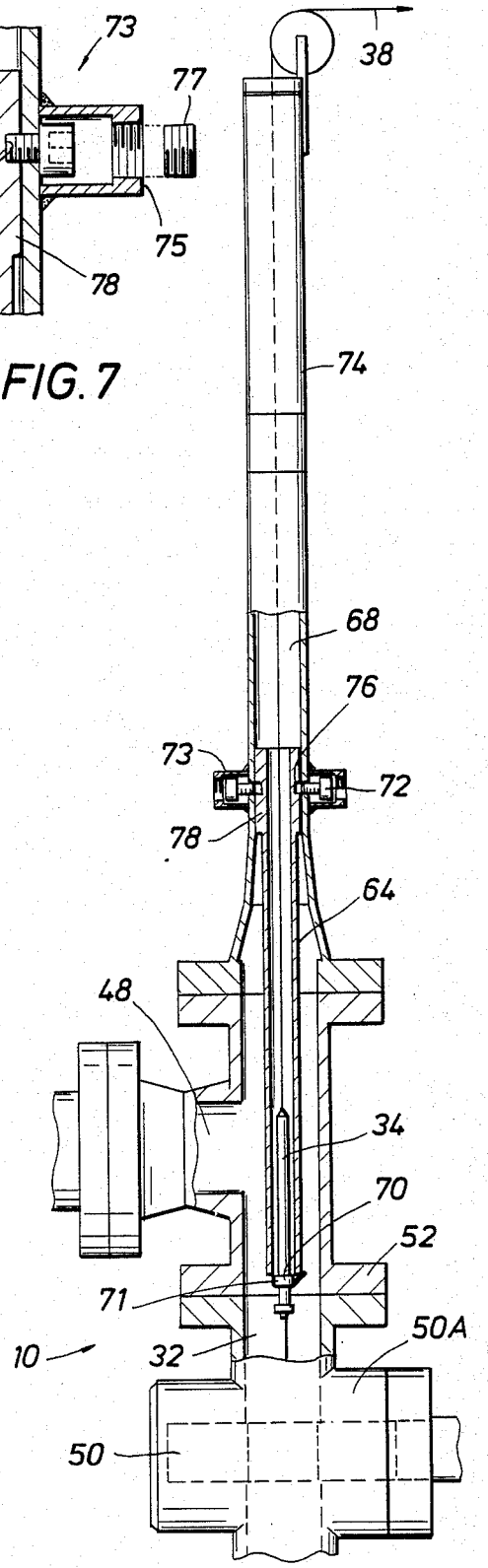
FIG. 4 is a partially cross-sectional view of the wellhead assembly of FIG. 3 in which the stinger is about to be moved to a retracted position.

With reference to removal of downhole tool 34, means are provided for moving stinger 64 from an extended position adjacent and projecting across injection port 48 to a retracted position upstream of isolation valve 50. In the preferred embodiment, stinger 64 is raised by raising downhole tool 34 until a catch 70 of the downhole tool engages the lower edge of the stinger. Catch 70 is provided by collar 71 in the illustrated embodiment. Injection through injection port 48 is suspended at a ballast or injection control valve 80 and stinger 64 is then released from its support with the central wellhead member 52 by the disengagement of a plurality of bolts 72 which pass through the wall of a lubricator 74 which is affixed to central wellhead member 52 in the preferred embodiment. The bolts are withdrawn from a groove 76 within base 78 of stinger 64 as illustrated in FIG. 4.

Figure 7:
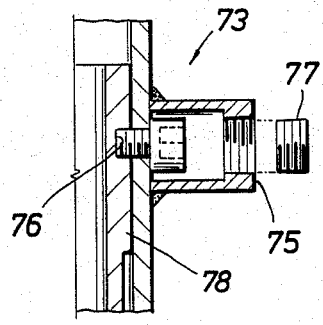
FIG. 7 is a cross-sectional close-up view of a means for securing the stinger to the wellhead assembly in accordance with the present invention.

It is preferred to provide a sealing means 73 for bolts 72 to prevent leakage through lubricator 74. FIG. 7 illustrates in greater detail the means for releasably securing stinger 64 to central wellhead assembly 52. Bolts 72 are sealed within a protective cover 75 and are accessable only through removable plugs 77. Such sealing means are commercially available under the names WELD-O-LET TM and THREAD-O-LET TM.

Figure 5:
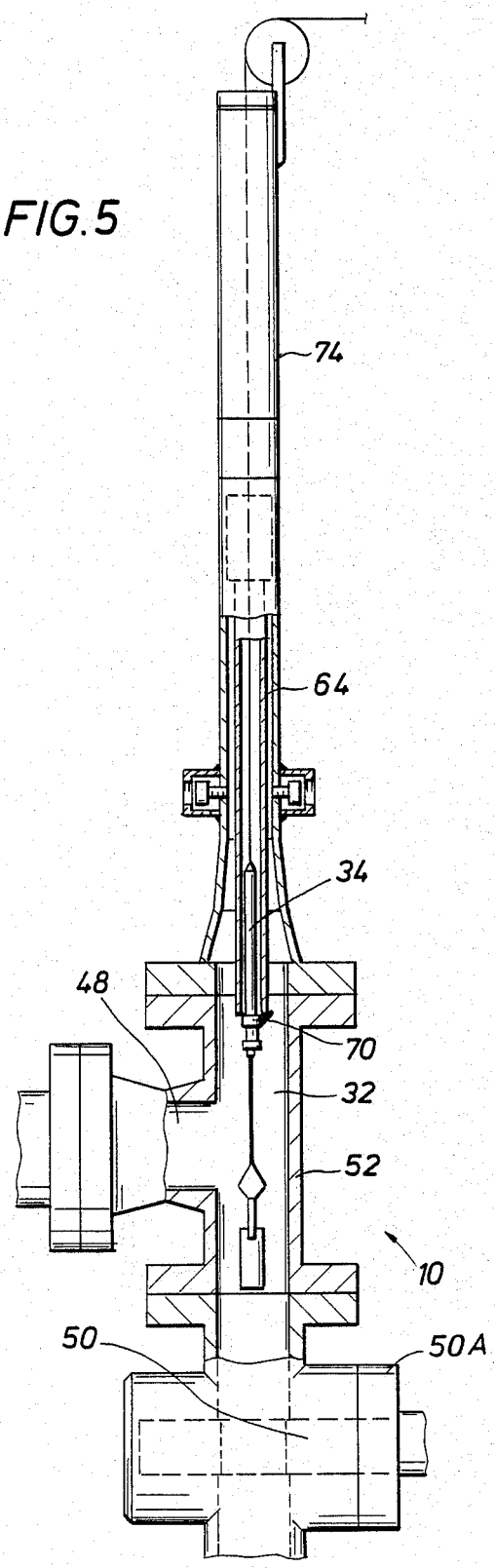
FIG. 5 is a partially cross-sectional view of the wellhead assembly of FIG. 3 in which the stinger is partially withdrawn.

Returning to the removal of downhole tool 34 as discussed with reference to FIGS. 5-6, further raising of downhole tool 34 will then draw stinger 64 into conduit 6 provided by lubricator 74 and clears tool 34 above isolation valve 50. See FIG. 5. In the illustrated embodiment, the full length of stinger 64 and of tool 34 are withdrawn into lubricator 74 as illustrated in FIG. 6. Isolation valve 50 is then closed and the downhole tool is isolated from downhole pressure.

Residual pressure is bled from the lubricator. Then downhole tool 34 can then be removed from wellhead assembly 10, preferably by removing lubricator 74 and the downhole tool from central wellhead member 52. In one embodiment the downhole tool is fully received within the lubricator.

The removal process is reversed to insert the tool into the wellhead assembly to deploy downhole tool 34. Thus, a wireline 38 is threaded through a stinger 64, and downhole tool 34 and the stinger are loaded into lubricator 74 which can be fastened to central wellhead member 52 to form the configuration illustrated in FIG. 6. Initial lowering of downhole tool 34 will lower stinger 64 down lubricator 74 as illustrated in FIG. 5, until the position of FIG. 4 is reached at which time bolts 72 are advanced to engage within grooves 76 on base 78 of stinger 64. Thereafter, further lowering of downhole tool 34 will advance the downhole tool through injection bore 34 until the downhole tool is at its operating depth. With stinger 64 in place, advancement of the ballast fluid through injection port 48 does not threaten wireline 38 or operation of downhole tool 34.

Further, in the configuration of the preferred embodiment illustrated in FIG. 3, stinger 64 is clear of isolation valve 50 even in its intended position. Thus, in an emergency situation, isolation valve 50 can be closed at the cost of cutting the wireline 38 and thereby losing the downhole tool. Despite this loss, the capability for immediate isolation in an emergency situation is a significant safety advancement over the prior art. Further, the convenience of downhole tool access and non-emergency isolation of the downhole environment under pressure without sacrificing downhole tools and wireline make the present invention a significant advancement over the prior art.

It will be apparent to those having ordinary skill in the art that the present invention is similarly applicable to other injection well applications such as enhanced recovery of hydrocarbons from a reservoir in which it may be desired to monitor reservoir conditions during injection.

Other modifications, changes and substitutions are intended in the foregoing disclosure and in some instances, some features of the invention will be employed without a corresponding use of other features. Accordingly, it is appropriate that the appended claims be construed broadly and in the manner consistent with the spirit and scope of the invention herein.

What is claimed is:

1. A wellhead assembly which accepts a downhole tool run on a wireline within an injection bore disposed to accommodate a substantial flow of an injection fluid, comprising:

a central wellhead member defining an upper end of the injection bore;

an injection port connected to the central wellhead member and communicating with the injection bore at an angle which directs the injection fluid on a path toward the wireline;

an isolation valve mounted in the central wellhead member downstream of the injection port and disposed to selectively close across the injection bore;

a stinger positioned in the injection bore which is supported by the central wellhead member and through which the wireline runs and which is movable between a retracted position permitting the downhole tool to be moved upstream to a position above the isolation valve and an extended position in the injection bore projection across the injection port in a position to protect the wireline at the directed path of the injection fluid entering the injection bore; and means for moving the stinger between the extended and retracted positions, said means being operably engaged between the stinger and the central wellhead member and comprising:

a catch on the downhole tool which engages the lower edge of the stinger such that the stinger is lifted when the downhole tool is run up the injection bore; and bolts releasably connecting the stinger to the central wellhead member in the extended position.

2. A wellhead assembly constructed in accordance with claim 1 further comprising a lubricator connected to the central wellhead member and communicating with the injection bore upstream of the injection port, said lubricator being adapted to receive the stinger upon retraction.

3. A wellhead assembly constructed in accordance with claim 1 wherein the wellhead assembly provides access to an underground product storage facility through a product annulus, and further comprising a product port connected to the central wellhead member and in communication with the product annulus.

4. A wellhead assembly providing access to an underground product storage facility through a pipe string having a ballast bore and a product annulus and which accepts a downhole tool run on a wireline through the wellhead assembly, the wellhead assembly comprising:

a central wellhead member engaged in fluid communication with an upper end of the ballast bore and an upper end of the product annulus;

a ballast port connected to the central wellhead member and communicating with the ballast bore;

a ballast control valve connected to the central wellhead member for controlling ballast input to the ballast port;

a product port connected to the central wellhead member and communicating with the product annulus;

a product valve operably connected to the product port for controlling product input for storage and product output for withdrawal through the product port;

an isolation valve mounted in the central wellhead member and disposed to selectively close across the ballast bore downstream of the ballast port;

a stinger positioned in the ballast bore which is supported by the central wellhead member and through which the wireline runs and which is movable between a retracted position above the isolation valve and an extended position projection across the injection port; and means for moving the stinger between the extended and the retracted positions, said means being operably engaged between the stinger and the central wellhead member.

5. A wellhead assembly constructed in accordance with claim 4 wherein the underground product storage facility is a cavern formed within a salt formation.

6. A wellhead assembly constructed in accordance with claim 4 wherein the pipe string has a plurality of product annuluses.

7. A wellhead assembly constructed in accordance with claim 4 further comprising a lubricator supported by the central wellhead member and communicating with the ballast bore upstream of the ballast port which receives at least part of the stinger in its retracted position.

8. A wellhead assembly constructed in accordance with claim 7 wherein the stinger has an interior dimension which will receive the downhole tool and the lubricator has an interior dimension which will receive the full length of the stinger and the downhole tool.

9. A wellhead assembly constructed in accordance with claim 4 wherein the means for moving the stinger comprises:

at least one bolt releasably securing the stinger to the central wellhead member in the extended position;

means for withdrawing the bolt to release the stinger; and a catch on the downhole tool which engages the lower edge of the stinger such that the released stinger is lifted when the downhole tool is run up the ballast bore.

10. A method for deploying a downhole tool run on a wireline within an injection bore, said method comprising:

threading the wireline through a stinger;

placing the downhole tool within a conduit positioned to communicate with the injection bore of a central wellhead member when an isolation valve mounted in the central wellhead assembly across the injection bore is open;

opening the isolation valve;

extending the stinger to a position adjacent an injection port to protect the wireline from erosion resulting from a flow of an injected fluid;

lowering the downhole tool to its operating depth;

establishing a flow of the injected fluid;

operating the downhole tool;

ceasing the flow of the injected fluid;

ceasing operation of the downhole tool; and moving the stinger to a selected position above the isolation valve comprising:

engaging a catch of the downhole tool with the stinger;

releasing the stinger from support by a central wellhead member by loosening bolts extending through the central wellhead member into a grove on a base of the stringer; and raising the downhole tool and the stinger above the isolation valve and into the conduit in communication with the injection bore;

closing the isolation valve; and removing the downhole tool from the wellhead assembly.

11. A method for deploying a downhole tool in accordance with claim 10 wherein the upstream conduit is a lubricator.

12. A method of deploying a downhole tool in accordance with claim 11 wherein removing the downhole tool comprises removing the lubricator from the central wellhead member with the stinger and the downhole tool inside.

13. In combination with a wellhead assembly for providing access to an underground product storage facility of the type which accepts a wireline tool and in which a pipe string communicates between the underground product storage facility and a central wellhead member, the pipe string having a ballast bore and a product annulus, a ballast port connected to the central wellhead member and providing access to the ballast bore through the central wellhead member, a product port connected to the central wellhead member and providing access to the product annulus through the central wellhead member, a ballast control valve operably connected to the ballast port and controlling the passage of a ballast fluid through the ballast port, a product valve operably connected to the product port and controlling the passage of a product fluid through the product port, and an isolation valve across the ballast bore, the improvement comprising:

the isolation valve mounted in the central wellhead member and disposed to selectively close across the ballast bore downstream of the ballast port;

a stinger supported by the central wellhead member and positioned in the injection bore through which the wireline runs and which is moveable between a retracted position above the isolation valve and an extended position projecting across the injection port; and means for moving the stinger between the extended and retracted positions, said means being operably engaged between the stinger and the central wellhead member.

14. An improved wellhead assembly constructed in accordance with claim 13 wherein the pipe string receives plurality of product annuluses.

15. An improved wellhead assembly constructed in accordance with claim 13 further comprising a lubricator supported by the central wellhead member and communicating with the ballast bore upstream of the ballast port which receives at least part of the stinger in its retracted position.

16. An improved wellhead assembly, constructed in accordance with claim 15 wherein the stinger has an interior dimension which will receive the downhole tool and the lubricator has an interior dimension which will receive the full length of the stinger and the downhole tool.

17. An improved wellhead assembly constructed in accordance with claim 13 wherein the means for moving the stinger comprises:

at least one bolt releasably securing the stinger to the central wellhead member in the extended position;

means for withdrawing the bolt to release the stinger; and a catch in the downhole tool which engages the lower edge of the stinger such that the released stinger is lifted when the downhole tool is run up the ballast bore.

* * * * *